US012129573B2

(12) United States Patent
Schrempf et al.

(10) Patent No.: US 12,129,573 B2
(45) Date of Patent: Oct. 29, 2024

(54) SPINNERET, METHOD OF HEATING A SPINNERET AND LYOCELL PROCESS

(71) Applicant: LENZING AKTIENGESELLSCHAFT, Lenzing (AT)

(72) Inventors: Christoph Schrempf, Bad Schallerbach (AT); Johann Pillichshammer, Frankenmarkt (AT); Andreas Gressenbauer, Schorfling am Attersee (AT); Ernst Reiter, Schorfling am Attersee (AT); Martin Neunteufel, Lantau Island, N.T. (CN)

(73) Assignee: Lenzing Aktiengesellschaft, Lenzing (AT)

( * ) Notice: Subject to any disclaimer, the term of this patent is extended or adjusted under 35 U.S.C. 154(b) by 452 days.

(21) Appl. No.: 17/417,848

(22) PCT Filed: Dec. 20, 2019

(86) PCT No.: PCT/EP2019/086705

§ 371 (c)(1),
(2) Date: Jun. 24, 2021

(87) PCT Pub. No.: WO2020/136118

PCT Pub. Date: Jul. 2, 2020

(65) Prior Publication Data

US 2022/0074074 A1 Mar. 10, 2022

(30) Foreign Application Priority Data

Dec. 28, 2018 (EP) ..... 18248182

(51) Int. Cl.

| | |
|---|---|
| ***D01D 4/02*** | (2006.01) |
| ***D01D 10/02*** | (2006.01) |
| ***D01F 2/00*** | (2006.01) |
| ***D01F 2/06*** | (2006.01) |

(52) U.S. Cl.

CPC ..... *D01D 4/02* (2013.01); *D01D 10/02* (2013.01); *D01F 2/06* (2013.01); *D01F 2/00* (2013.01)

(58) Field of Classification Search

None

See application file for complete search history.

(56) References Cited

U.S. PATENT DOCUMENTS

| | | | | |
|---|---|---|---|---|
| 3,130,448 | A | 4/1964 | Tomlinson | |
| 5,527,178 | A | 6/1996 | White et al. | |
| 5,652,001 | A | 7/1997 | Perry et al. | |
| 6,053,719 | A * | 4/2000 | Barbier | D04H 3/011 425/81.1 |

(Continued)

FOREIGN PATENT DOCUMENTS

| | | |
|---|---|---|
| CN | 102061531 A | 5/2011 |
| EP | 0 756 025 A2 | 1/1997 |

(Continued)

*Primary Examiner* — John J DeRusso

(74) *Attorney, Agent, or Firm* — Venable LLP

(57) ABSTRACT

A method of producing lyocell filaments employs a steam heatable spinneret having a rectangular shape with an aspect ratio of more than 2 and comprising at least a top housing and a nozzle frame. The spinneret is heated and used for spinning cellulosic filaments from a cellulose solution in a solvent. A lyocell process employs the spinneret.

10 Claims, 1 Drawing Sheet

(56) References Cited

U.S. PATENT DOCUMENTS

| | | | |
|---|---|---|---|
| 6,190,596 | B1 | 2/2001 | Budgell et al. |
| 6,926,508 | B2 | 8/2005 | Brady et al. |
| 2002/0043733 | A1 | 4/2002 | Brady et al. |

FOREIGN PATENT DOCUMENTS

| | | | | |
|---|---|---|---|---|
| EP | 0 700 456 | B1 | 3/1999 | |
| IN | 205241867 | U | 5/2016 | |
| JP | 2004502043 | A | 1/2004 | |
| KR | 20150104933 | A | 9/2015 | |
| WO | 94/28209 | A1 | 12/1994 | |
| WO | 98/06754 | A1 | 2/1998 | |
| WO | WO-03014429 | A1 * | 2/2003 | ..... D01D 4/00 |

* cited by examiner

SPINNERET, METHOD OF HEATING A SPINNERET AND LYOCELL PROCESS

The present application is a national-stage entry under 35 U.S.C. § 371 of International Patent Application No. PCT/EP2019/086705, published as WO 2020/136118 A1, filed Dec. 20, 2019, which claims priority to EP 18248182.0, filed Dec. 28, 2018, the entire disclosure of each of which is hereby incorporated by reference.

BACKGROUND OF THE INVENTION

Field of the Invention

The present invention relates to a spinneret, and a method of heating a spinneret used for spinning cellulosic filaments from a cellulose solution in a solvent. The invention also relates to a lyocell process employing such a spinneret

Description of Related Art

Spinnerets are employed for the production of fibers and filaments of various chemical nature, including cellulose derived fibers and filaments. One example of such a spinneret is a spinneret which is employed in the lyocell process, for example a spinneret having a plurality of nozzle plates which each have a plurality of holes for the spinning of filaments, and the nozzle plates being located in a quadrilateral frame surrounding them on all sides. Such a spinneret is for example known from EP-A-0,756,025 or from EP-A-0,700,456.

Another example is the spinneret disclosed in WO 03/014429. That document discloses a spinneret with several flat perforated plates of metal, which each have several holes for the spinning of filaments. The perforated plates in that case have been fitted on all sides in a frame section of stainless steel. These spinnerets may for example be employed for the preparation of lyocell fibers and filaments.

As is known, prior to spinning, the cellulosic starting material for the lyocell process is dissolved in an appropriate solvent at elevated temperature, generally at about 70 to 130° C. to yield a spinning mass. This solution, after optional additional process steps, for example for removing impurities and for ensuring a high degree of homogeneity is then forwarded to a spinneret, to produce fibers and filaments. In this step of the lyocell process it is mandatory to ensure a control of the temperature distribution within the spinning mass, as temperature variances within the spinning mass may lead to undesired variance in relation with the fibers and filaments produced. While such a variance might not be so critical in relation with staple fiber production, variances of filaments produced give rise to inhomogeneities within the filament yarns obtained which are detrimental for the further use of the filament yarns.

For filament production it is therefore important to ensure a good temperature control, so that the any differences of the temperature of the spinning mass are within a window as small as possible. In this context the shape of the spinneret is an important factor to consider.

It is generally possible to ensure negligible temperature variances in the spinning mass in round spinnerets (aspect ratio 1) or spinnerets having an aspect ratio close to 1 (square shaped spinnerets). An example of a round spinneret is disclosed in CN 205241867 U. Another example is given in U.S. Pat. No. 3,130,448. In these cases it is sufficient to heat the spinneret with hot water or by means of electrical heating elements. However, problems have been encountered when using spinnerets having an aspect ratio of more than 2, such as a spinneret disclosed in WO 03/14429 discussed above.

These types of spinnerets however have proven to be of commercial relevance, in particular for high speed filament production, as they enable the production of a high number of filaments (by using multiple nozzle plates within the spinneret frame) with an optimum use of the frame capacity (in particular for rectangular frames). The incentive to employ such spinnerets however is associated with the drawback that for filament production, where the variance in filament properties must be as small as possible to ensure high product quality, the required temperature control and adjustment within the spinneret is no longer possible by using hot water or electric heating means. The demands for filament uniformity are such that titer deviations within a given filament production must be within +/−5%, preferably within +/−2.5%.

OBJECT OF THE INVENTION

The present invention accordingly seeks to provide a method of ensuring the required titer control in a spinneret for spinning cellulosic filaments from a cellulose solution in a solvent, which spinneret, especially at high throughput and high speed, ensures a good uniformity of the filaments and at least reduces problems associated with the prior art spinnerets.

BRIEF DESCRIPTION OF THE INVENTION

Surprisingly, this object is met by a steam heatable spinneret, a method of ensuring temperature control of the spinning mass within a spinneret and a method of producing lyocell filaments employing a steam heatable spinneret. Preferred embodiments are given in the subclaims as well as the following description.

DESCRIPTION OF THE DRAWINGS

The invention is further described with reference to the accompanying drawings in which.

DETAILED DESCRIPTION OF THE INVENTION

Figure 1:
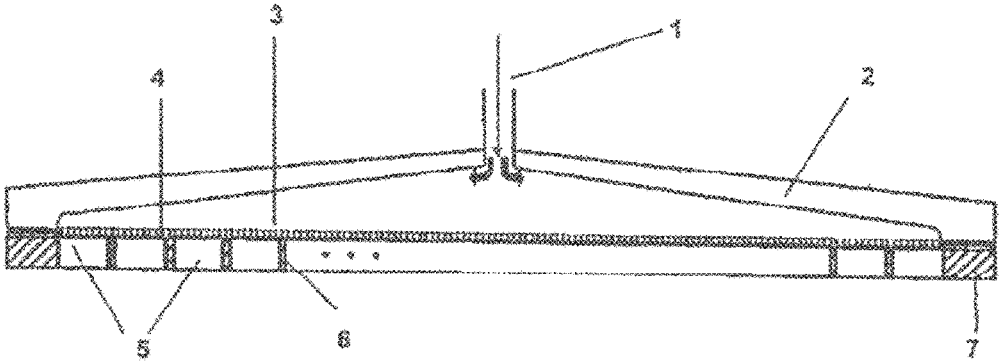
FIG. 1 is a schematic figure which shows a nozzle block containing an embodiment of the spinneret according to the invention in cross-section.

In accordance with the present invention, the term spinneret is employed herewith to designate the part of a device for producing lyocell which ensures that the spinning mass or spinning solution is formed into filaments, which in particular includes a nozzle frame, optionally individual nozzle plates spaced within the frame, and a top housing covering the nozzle frame creating a space into which the spinning mass/solution is introduced prior to filament formation. In the context of the present invention the terms "spinneret", "nozzle block" etc. may be used interchangeably. The aspect ratio being an integral part of the definition of the spinneret of the present invention however relates to the aspect ratio of the part of the spinneret forming the nozzle section of the spinneret (i.e. that part which defines the area through which filaments are extruded).

Within the framework of the present invention, the production of lyocell filaments starts with the preparation of a spinning solution or spinning mass, by dissolving cellulose in a solvent. A preferred solvent employed in the production of lyocell filaments, is a tertiary amine N-oxide and, optionally, water admixed therewith. The solution of cellulose in the tertiary amine N-oxide and, optionally, water is then extruded in the hot state with the aid of a spinneret and is formed (shaped) in the extrusion process. For filament production, in particular high speed filament production, this requires a good temperature control of the spinning mass. Such a temperature control should ensure that the spinning mass shows only a small temperature variance so that the filaments produced likewise do not show a detrimental variance in relation with filament properties, in particular filament titer, which would have a detrimental effect on the properties of the final product (such as a filament yarn).

As outlined above, this problem is in particular relevant when using spinnerets, which may comprise multiple nozzle plates for filament extrusion, are in principle of rectangular shape having an aspect ratio of more than 2. The present invention, as identified in the claims and as further described here overcomes these problems by using steam for heating the spinneret, so that the required uniformity of the temperature profile of the spinning mass prior to exiting the spinning nozzles is ensured.

In accordance with the finding of the present invention the multi filament spinneret, preferably a spinneret comprising multiple nozzle plates arranged within a frame having a rectangular shape, has an aspect ratio of more than 2. It has been proven by carrying out test runs with spinnerets of different aspect ratios, that the spinneret may have aspect ratios as high as 10 or more, such as 12 or more and even 15 or more. As long as the spinneret is adapted to allow heating of the spinning mass within the spinneret by steam, preferably by providing channels, which preferably are microchannels within the spinneret top housing and/or the nozzle frame to heat the spinneret uniformly by means of steam injection into these channels, the required uniformity of the filament production can be ensured.

Examples of enabling steam heating are the provision of channels and micro channels (diameters of 1 mm or more) within the nozzle frame, nozzle plates or even closer to the individual nozzles, for example by providing channels in the close vicinity of the individual nozzles. As long as these channels can be provided within the respective part of the spinneret without detrimental effect on the mechanical integrity, these channels may be provided. Typically the top housing is not heated by means of steam injection into channels but by providing the top housing with suitable means enabling steam heating of major parts of the inner surface thereof, for example by means of double walled parts and heating jackets.

Figure 2:
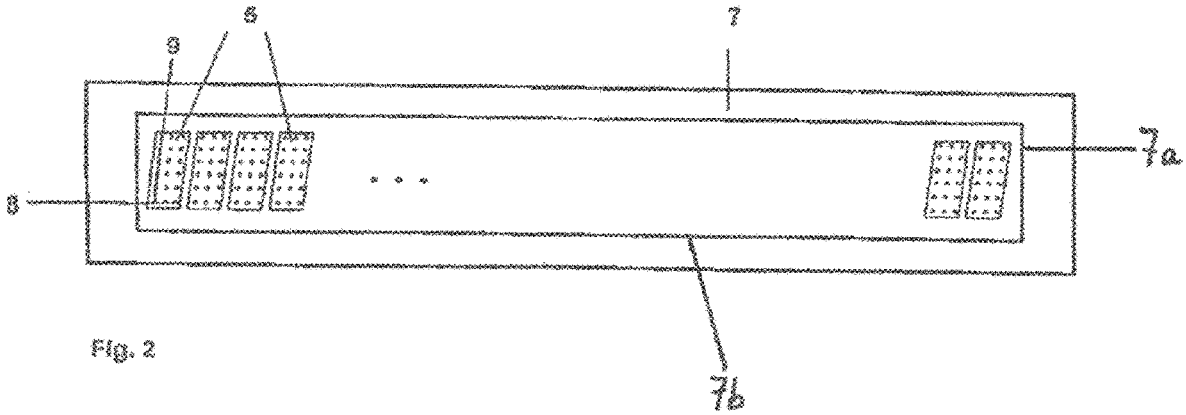
FIG. 2 is a schematic figure which shows an embodiment of the spinneret according to the invention in plan view from above.

Reference is made here to FIGS. 1 and 2 illustrating the invention. In FIG. 1 a spinneret is shown with an inlet 1 for the dope. The dope is supplied to the centre of a heatable top part 2 (top housing) of the spinning block. In accordance with one embodiment of the present invention at least this top housing provides means that allow steam heating of the housing to ensure temperature control of the spinning mass. Connected to the top housing 2 is a wire gauze 3, which is situated on a breaker (distributor) plate 4.

Quadrilateral nozzle plates 5 are placed in a nozzle frame 7, which again is in one embodiment of the present invention preferably adapted to be heated by means of steam. The nozzle plates are separated from one another by lands 6. These lands 6 at the same time serve as reinforcement for the breaker plate 4. In accordance with the present invention it is also preferred if these lands are connected to the nozzle frame and furthermore it is preferred when also these lands are adapted to be heated by means of steam.

In FIG. 2 a top view on the nozzle frame 7 and the nozzle plates 5 is shown. Furthermore, rows 8 of holes for the spinning of filaments and columns 9 of these spinneret holes are shown. Lines 7*a* and 7*b* define the area available for the actual spinning of filaments and accordingly are defining the aspect ratio.

As indicated above, it has been found to be effective, if the spinneret not only allows steam heating of the top housing of the spinneret or the nozzle frame, but steam heating close to the individual nozzle plates as well as for the top housing, for example by providing channels for steam heating also within the frame into which the individual nozzle plates are placed (nozzle frame), or, if present, also within any parts of the nozzle frame forming individual nozzle plate frames within the larger nozzle frame (so that each nozzle plate is surrounded by an individual frame, which may be advantageous in relation with pressure stability of the overall spinneret arrangement, i.e. lands (6)).

It has been found surprisingly that by using steam as the heating medium a very uniform temperature within the spinning mass can be ensured, so that uniform filaments are obtained.

The term steam as employed here refers to water in the gaseous phase, preferably dry steam (i.e. steam not containing water droplets) and supercritical steam. Steam temperature preferably is in the range of from 105 to 138° C., preferably from 110 to 130° C., at pressures of from 1.0 to 4 bar, preferably 1.2 to 3.8 bar, more preferably 1.5 to 3.4 bar (i.e. not a low pressure steam but excess pressure preferably of from 0.2 to 2.8, in particular 0.5 to 2.4 bar). Preferably the steam is saturated steam. As is in particular shown in the examples, by using an excess pressure a surprising improvement in uniformity of the filaments produced can be achieved.

The present invention of course also envisages a combination of heating types, for example steam heating of the top housing and electric heating of the nozzle frame etc. . . . As long as the spinneret employed in accordance with the present invention allows for steam heating at least of the top housing any combinations of ways of providing heating may be employed.

The individual parts of the spinneret may be prepared from usual materials employed in the art, such as (stainless) steel. As the present invention aims to provide a superior temperature control (involving in particular good heat transfer), materials allowing good heat transfer are preferred for producing the relevant parts of the spinneret.

The type and shape of the individual nozzle plates is not critical, for example those disclosed in WO 03/014429 may be employed. Likewise, the number of nozzle plates located within the frame in a multi nozzle plate spinneret ordinarily is not subject to any restrictions. However, for the spinnerets of the invention it is preferred when up to 100, preferably 30 to 60, nozzle plates are located within a frame. There is as little restriction with respect to the number of holes in the nozzle plates. As general rule, however, it is preferred when the individual nozzle plates in the case of the spinnerets claimed have from 3 to 1000, preferably from 20 to 300, more preferably from 30 to 120, holes for the spinning of filaments.

The invention in a preferred embodiment provides a nozzle block which contains a steam heatable top housing, a screen packing, a breaker (distributor) plate, and a spinneret (nozzle frame and optional individual nozzle plates arranged within the frame if the frame is not already a multifilament spinning nozzle) according to the invention, with the aspect ration as defined. Advantageously, the nozzle block is designed to be supplied by only one spinning pump, i.e. the supply of the cellulose solution to the nozzle block takes place with a single pump. Each nozzle plate within the spinneret in that case corresponds to one thread or multifilament composed of the number of filaments resulting from the number of spinning holes in this nozzle plate.

As a rule, the spinning mass (dope) is filtered before it is conveyed to the spinning block. In the filtering process candle filters, for example metal wool filters with a fineness between 5 and 50 pm, have proved useful. Other means may be employed as well, such as textile or fabric filters (webs, meshes etc.), as long as the fineness is as required for the lyocell process. Preferred are candle filters. The preparation of cellulosic dopes in appropriate solvents, e.g. tertiary amine N-oxide and, optionally, water, is known to the skilled person and is described for instance in WO 98/06754 and the literature cited therein, so that it does not need any further elucidation here.

Before the dope reaches the spinneret, it is advantageously led through a screen packing, which may for instance—be made up of a braided fabric of metal with a fineness between 15 and 50 pm. This screen packing lies directly on a breaker plate, which is followed by the actual spinneret, which consists of the above-described frame and the nozzle plates. The nozzle plates have desirably been welded into the frame. The nozzle block is, for example, made of stainless high-grade steel.

The steam heatable top housing of the nozzle block serves to provide even distribution of the dope over the entire length and width of the spinneret. In this process the dope may be carried to the center of the top housing, for instance via a flexible metal tube or a metal conduit. Preferably these are heatable, for example by providing heating jackets or double walled structures which allow introduction of a heating medium. Suitable examples are flexible double walled tubes, which allow for example heating by means of water or steam. The volume of the top housing is preferably kept small, because the dope at elevated temperatures and longer residence times has a tendency towards decomposition reactions. On the other hand, the residence time must be long enough to keep the dope at a constant temperature over the entire length and width. In this way it is ensured that the dope stream is very uniform. Every hole in the nozzle plate thus receives the same amount of cellulose solution and the resulting filaments or threads have very high uniformity. In this regard it is preferred, as already outlined above, if not only the top housing is steam heatable but also the nozzle frame, including any lands provided for securing the individual nozzle plates.

The skilled person is in a position to determine the dimensions of the top housing through simple experiments and corresponding rheological calculations. Underneath the top housing there is usually the breaker plate with the wire gauze lying thereon. The wire gauze or screen packing serves for a final filtration before the spinneret and protects the relatively fine spinning holes in the nozzle plates from dirt contamination. The holes for the spinning of filaments preferably have a diameter from 30 to 200 pm, more preferably from 60 to 130 pm. Furthermore, the flow-pressure drop caused by the wire gauze serves to increase the dope uniformity as regards pressure, temperature and homogeneity over the length and width of the entire spinneret. The breaker plate likewise serves to make the dope uniform as regards pressure, temperature and homogeneity over the length and width of the entire spinneret as well as to support the wire gauze.

In a preferred embodiment, the breaker plate is made of a highly thermally conductive material. Unlike in the case of the commonly used breaker or support plates, the temperature of the dope can be made uniform even at right angles (transversely) to the direction of flow and thus across all spinning positions when highly thermally conductive materials are used. It is preferred in that case to make use of materials for the breaker plate of which the specific thermal conductivity is above about 50 W/(m*K), preferably above about 80 W/(m*KA Examples of such materials are silicon carbides (about 100 W/(m*K)).

As was stated earlier, the nozzle plates are generally welded individually into the frame. The nozzle plates of the spinneret according to the invention preferably are flat and have a thickness in that case of from 1 to 3 mm, preferably about 1.5 to 2 mm, and are designed for pressures above about 60 bar.

Because of the uniform heat distribution within the spinneret according to the invention as well as within the nozzle block which contains this spinneret, it is possible to produce in a very economical manner a large number of cellulosic multifilaments with at the same time good quality and process stability. This applies especially for spinning rates of the filaments of more than about 500 m/min, preferably more than 800 m/min. In principle, there is no restriction on the attainable spinning rates. Even at rates of 1,500 to 2,000 m/min filaments of very good quality are still obtained.

While the present invention has been described above mainly in the context of a steam heatable spinneret/nozzle block, the skilled person will understand that this description likewise applies to the claimed method of heating a spinneret as well as to the claimed method of producing lyocell filaments. In particular in relation with the production of lyocell filaments the skilled person will understand, that by using steam heating as described herein, an improvement in particular in relation with the uniformity of the produced lyocell filaments can be achieved, an improvement neither disclosed nor suggested by the prior art. The method for producing lyocell filaments according to the present invention involves typically a filtering step and a screen-packing step, as well as the usual preparation steps for obtaining a spinning mass/solution according to the lyocell process. Spinning is carried out in a typical way, often employing an air gap between the spinneret and the coagulation bath. Typical subsequent steps involve washing and post spinning treatment steps (application of filament surface treatment agents etc.), as well as drying and winding steps.

Examples

Lyocell filaments were produced using identical spinning solutions at standard conditions, employing spinnerets with differing aspect ratios as well as different means of heating of the spinneret (heating with water (118° C.) or steam (118° C. 1.9 bar), heated regions of the spinneret/nozzle block were top housing and nozzle frame). The resulting filaments were evaluated with respect to filament titer (average as well as minimum and maximum titer) and standard deviations were calculated. In the context of the present invention a standard deviation (STD) of 0.15 or less is considered as being acceptable, with values for STD of less than 0.15, in particular 0.1 or less being preferred.

It has been found that for round shaped spinnerets (diameter 50 cm or more) as well as spinnerets having an aspect ratio of below 2, satisfactory filaments can be produced, with STD values of about 0.15, even when using water as the means for providing heat.

Using rectangular spinnerets with aspect ratios of 12 and 15, respectively, water heating yielded filaments with STD values of more than 0.15 and in embodiments as high as 0.2 or more. Contrary thereto, under otherwise identical conditions, steam heating of the spinneret yielded filaments with STD values of below 0.15, in embodiments even below 0.1.

Additional experiments were run as summarized in the table below. The values in the columns ® C. and bar define the temperature of the heating medium employed as well as, in case of steam, the pressure, which at the given temperature is required to obtain this temperature within a saturated steam.

| Type of nozzle | Heated with Top housing | Heated with Nozzle frame | Aspect ratio | STD | ° C. | bar |
|---|---|---|---|---|---|---|
| Rectangular | Water | — | 6.1 | 0.211 | 126 | |
| Rectangular | Steam | — | 6.1 | 0.133 | 126 | 2.45 |
| Round | Water | — | 1 | 0.131 | 116 | |
| Rectangular | Steam | Steam | 11.3 | 0.087 | 118 | 1.9 |
| Rectangular | Water | — | 4.5 | 0.166 | 122 | |
| Rectangular | Water | Water | 4.5 | 0.15 | 122 | |

Again the results confirm the concept of the present invention, namely that by employing steam heating the uniformity of the filaments produced increases drastically for rectangular spinnerets with the defined aspect ratio. Even when both, the top housing and the nozzle frame are heated with water, the uniformity does not reach the level achieved with steam heating. These results also confirm that STD values of 0.14 or less can be achieved with in accordance with the present invention, while water heating only makes available filament uniformities corresponding to STD values of 0.15 or above.

Accordingly, the present invention provides a means to ensure titer homogeneity by means of temperature control within the spinneret by means of steam heating.

What is claimed is:

1. A method of producing lyocell filaments; employing a steam heatable spinneret having a rectangular shape with an aspect ratio of more than 2 and comprising at least a top housing and a nozzle frame, the method comprising:

preparing a spinning solution and extruding the spinning solution with the steam heatable spinneret, wherein the top housing or the top housing and the nozzle frame is heated by steam having a temperature ranging from 105 to 138° C. and a pressure ranging from 1.2 to 4 bar.

2. The method according to claim 1, wherein the steam heatable spinneret further comprises individual nozzle plates within the nozzle frame.

3. The method according to claim 1, wherein the top housing and the nozzle frame are heated by steam.

4. The method according to claim 1, wherein the steam heatable spinneret is further heated by additional heating that is different from heating by steam.

5. The method according to claim 1, wherein the steam heatable spinneret has an aspect ratio of from 5 to 25.

6. The method according to claim 1, wherein the top housing or the top housing and the nozzle frame is heated by steam having a temperature ranging from 110 to 130° C. and a pressure ranging from 1.5 to 3.4 bar.

7. The method according to claim 1, wherein the top housing and the nozzle frame are made of stainless steel.

8. The method according to claim 1, wherein the steam heatable spinneret further comprises a breaker.

9. The method according to claim 8, wherein the breaker is steam heatable.

10. The method according to claim 1, wherein the steam heatable spinneret is a multi-nozzle plate spinneret, wherein the nozzle frame comprises lands which are steam heatable.

* * * * *